United States Patent [19]

Greenlee et al.

[11] 4,222,621

[45] Sep. 16, 1980

[54] DEVICE FOR STORING AND DISPENSING TISSUES, TOWELS, AND THE LIKE THAT ARE PROVIDED IN THE FORM OF ROLLS

[76] Inventors: Lois J. Greenlee; Lyman R. Greenlee, both of 1105 LaSalle, Belleville, Ill. 62221

[21] Appl. No.: 56,722

[22] Filed: Jul. 11, 1979

[51] Int. Cl.[3] ..... B65H 19/04; B65H 49/00

[52] U.S. Cl. ..... 312/37; 242/55.3; 312/41; 312/97.1

[58] Field of Search ..... 242/55.3; 198/347; 312/183, 268, 91, 267, 37, 38, 41, 39, 40, 97.1; 221/281; 211/6, 16

[56] References Cited

U.S. PATENT DOCUMENTS

| | | | |
|---|---|---|---|
| 846,962 | 3/1907 | Thayer | 242/55.3 |
| 896,251 | 8/1908 | Sappenfield | 242/55.3 |
| 1,407,746 | 2/1922 | Hagarty | 312/91 X |
| 1,408,283 | 2/1922 | Ferdon | 211/16 X |
| 2,603,547 | 7/1952 | Zook | 312/268 X |
| 2,668,572 | 2/1954 | Bostwick | 242/55.3 X |
| 3,190,707 | 6/1965 | Eisenberg | 312/184 |
| 3,677,485 | 7/1972 | Berg | 312/38 X |
| 3,700,181 | 10/1972 | Diring et al. | 312/38 X |

*Primary Examiner*—James T. McCall

*Attorney, Agent, or Firm*—Gravely, Lieder & Woodruff

[57] ABSTRACT

A device for storing and dispensing tissues, towels, and the like, that are provided in the form of a roll. The device comprises a pair of belts which can be caused to move over a surface of rollers by the action of drive wheels. To the belts are joined a plurality of pairs of holding units which retain the tissue rolls. The foregoing assembly is provided with a base to facilitate attachment to a wall, and a decorative cover for aesthetic purposes.

8 Claims, 5 Drawing Figures

FIG. 4
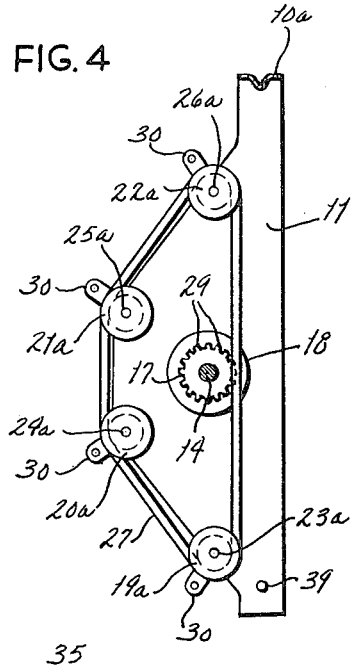
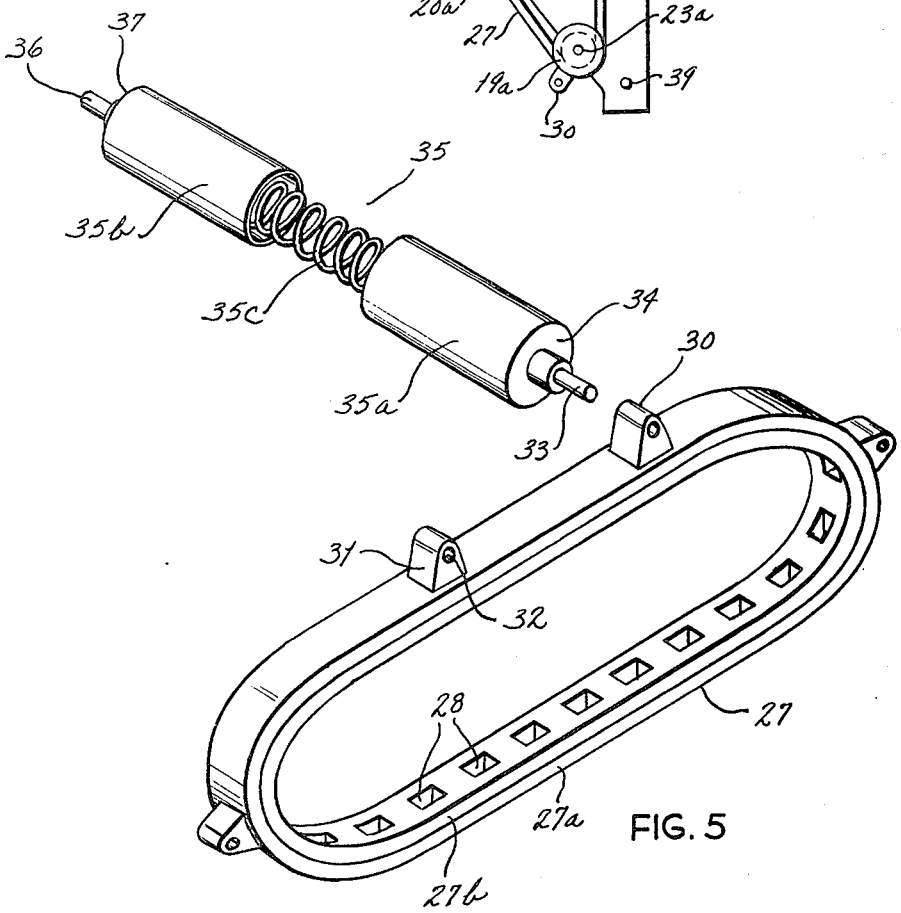
FIG. 5

DEVICE FOR STORING AND DISPENSING TISSUES, TOWELS, AND THE LIKE THAT ARE PROVIDED IN THE FORM OF ROLLS

BACKGROUND OF THE INVENTION

In public and private restrooms, it is common to see rolls of toilet paper and paper towels mounted securely on brackets which are attached to the wall. Because of the shortage of maintenance personnel, it is highly likely that by the end of a given working day, the roll of toilet paper or roll of paper towels is used up.

Consequently, users of the restroom are unable to use all or part of the facility until an attendant has replaced the rolls of toilet paper or rolls of paper towels.

Accordingly, it is an object of this invention to provide a tissue dispenser which eliminates or reduces the requirement of daily maintenance.

It is a further object to provide such a dispenser that is aesthetically attractive.

It is still a further object to provide such a dispenser that is of simple construction and, consequently, relatively inexpensive.

BRIEF DESCRIPTION OF THE DRAWINGS

FIG. 4 is a sectional view taken along line 4—4 of FIG. 2.

FIG. 5 is an exploded perspective view of the belt and spring-loaded retention core which forms part of the device.

SUMMARY OF THE INVENTION

This invention relates to improvements in dispensers for tissues, towels and other paper and plastic products that are commonly provided in the form of rolls. More specifically, the invention relates to dispensers that are capable of storing several rolls of tissues, towels, etc.

The preferred embodiment comprises a frame made of a back plate and two side plates, a left side plate and a right side plate. Through apertures in the left side plate and in the right side plate is disposed a rotatable shaft which can be turned from outside of the frame. Attached to the shaft are a pair of drive wheels which rotate along with rotation of the shaft. In the same planes as the drive wheels are sets of rollers, which are mounted on the left side plate and right side plate. Belts made of flexible material are wrapped over each set of rollers. These belts have both an interior and an exterior surface. On the exterior surface are mounted means for retaining the rolls which hold the tissues, towels, etc.; on the interior surface are holes which engage the teeth on the drive wheel. When the rotatable shaft is turned, the drive wheels also turn and move the belts over the surface defined by the rollers. In this manner, the unused rolls of tissue will reach a position where the user has access to them.

DETAILED DESCRIPTION

Figure 1:
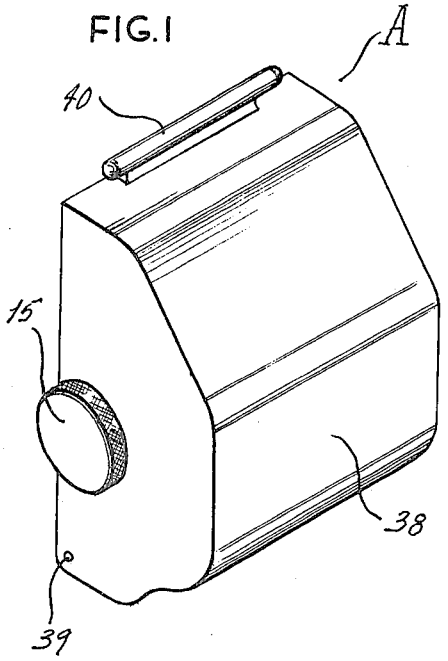
FIG. 1 is a perspective view of a dispensing device constructed in accordance with and embodying the present invention.
Figure 2:
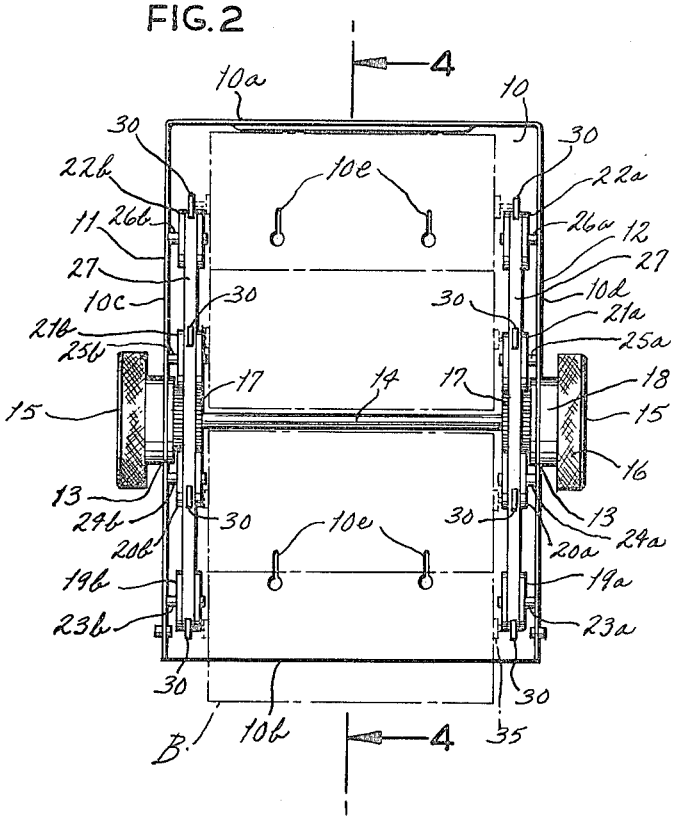
FIG. 2 is a front elevational view of the device with the cover removed.

The dispenser assembly A, has as its base, a back plate 10, which may be made of metal, plastic, wood, or any other suitable substitute. The back plate 10 is preferably of rectangular cross section and has a top 10*a*, bottom 10*b*, and two sides, a left side 10*c*, and a right side 10*d*. The dispenser assembly "A" is joined to a wall surface (not shown) by means of the back plate 10. The preferred embodiment has a series of key shaped mounting holes 10*e*, by means of which the assembly can be hung on a wall [See FIG. 2].

Projecting at a 90° angle from side 10*c* of the back plate 10 is the left side plate 11. Likewise, the right side plate 12 projects at a 90° angle from side 10*d* of the back plate 10. The side plates 11, 12 are made of the same material as the back plate 10. The side plates 11, 12 may be separable from the back plate 10 or they may be of unitary construction with the back plate.

Figure 3:
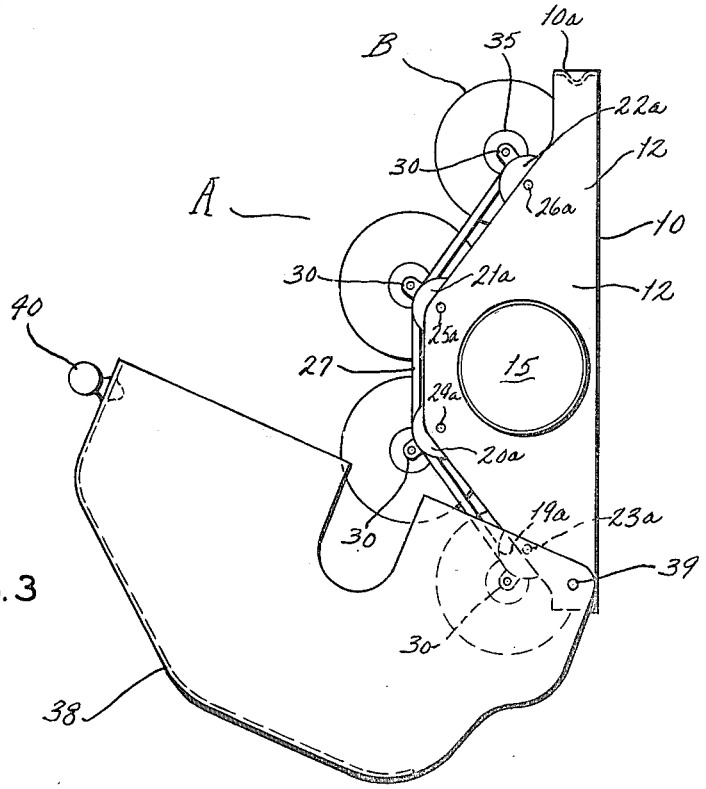
FIG. 3 is a side elevational view of the device showing the cover in its open position.

In the preferred embodiment, the side plates 11, 12 have essentially trapezoidal cross-sections [See FIG. 3]. However, the cross-section may be rectangular, triangular, or other shape if so desired. Irrespective of their configuration, the side plates 11, 12 must project far enough from the back plate 10 to completely enclose the inner workings of the dispenser, including the rolls to be stored and dispensed.

Each of the side plates 11, 12 has an aperture 13 formed therein. A rod 14 extends through the apertures 13 in the side plates 11, 12 and is fitted at its ends with hand wheels 15. Each hand wheel 15 includes a knurled gripping portion 16 that is located outermost, a drive wheel 17 that is located innermost and a hub 18 that is between the gripping portion 16 of the hand wheel 15 and drive wheel 17. The rod 14 is secured by means of the hub 18. The hub 18 has a groove formed in its surface which engages the edges of the aperture 13 to secure rod 14 in a stable position but still permitting rotation when a torque is applied to the rod 14. The torque can be applied through the hub 18 by turning the hand wheel 15.

Mounted on the rod 14 within the frame formed by the back plate 10 and side plates 11, 12 are a pair of drive wheels 17. In the preferred embodiment, the drive wheels 17 are sprocket wheels [See FIG. 4]. The wheels 17 should be separated by a distance substantially equivalent to the length of the roll to be used. The drive wheels 17 should each be sent in from their respective side plates 11 or 12 an equal distance in order to insure that the dispenser will be balanced when mounted properly on a wall. The wheels may be made of metal, plastic, or any other suitable material.

Mounted on the interior surface of the side plates 11, 12 are a plurality of pairs of rollers (19*a*, 19*b*, 20*a*, 20*b*, 21*a*, 21*b*, 22*a*, 22*b*). The rollers 19*a*, 20*a*, 21*a*, 22*a* mounted on the right side plate 12 are in the same plane as the drive wheel 17 that is adjacent to the right side plate 12. Each roller on the right side plate 12 has a corresponding roller on the left side plate 11—i.e. roller 19*a* corresponds in position to roller 19*b*, and is the mirror image thereof; this same relationship holds for rollers 20*a*, 20*b*, rollers 21*a*, 21*b*, and rollers 22*a*, 22*b*. The rollers 19*a*, 19*b*, 20*a*, 20*b*, 21*a*, 21*b*, 22*a*, 22*b* are mounted to the side plates 11, 12 by means of axles 23*a*, 23*b*, 24*a*, 24*b*, 25*a*, 25*b*, 26*a*, 26*b*, respectively. The axles project inwardly from the side plates 11, 12 to such a distance that the rollers, when mounted on the axles, lie in the same plane as the related drive wheels 17.

It should be understood that the device is not to be limited to employing eight and only eight rollers. The dispenser may operate with fewer rollers or with more rollers; moreover, it is not necessary that the number of rollers joined to each side plate be equal.

The rolls of tissue, towels, etc., are retained on and are moved by endless belts 27 which pass over and are supported on the rollers 19*a*, 19*b*, 20*a*, 20*b*, 21*a*, 21*b*, 22*a*, 22*b* and are engaged by the drive wheels 17. Each belt 27 is constructed of a flexible material, preferably plastic. However, it can be made of other flexible materials or metal. In the preferred embodiment, the belt 27 consists of two plies 27*a*, 27*b* of flexible material. The belt formed from the plies is formed into a loop, as shown in FIG. 5. The loop is placed over the rollers and the drive wheel 17 so that the inner ply 27*b* engages the drive wheel 17 and the rollers. The inner ply 27*b* has evenly spaced holes 28 set therein which will allow the loop to engage the teeth 29 of the drive wheel 17. As the drive wheel 17 is revolved, the belt 27 will move by virtue of the action of the teeth. The outer ply 27*a* forms the base for the core holders 30. The core holders 30 are made of the same material as the belt itself 27. In the preferred embodiment of the invention, the core holders 30 are molded to the outer ply 27*a* of the belt 27, and thus form an integral part of the belt 27. The preferred embodiment of the core holder 30 is a tab 31 projecting from the belt 27, and having a hole 32 established therein to receive a spindle 33 on one end 34 of a spring-loaded retention core 35 upon which the roll of tissue is retained. The other belt 27 has an identical tab 31 projecting therefrom, also having a hole 32 to receive a second spindle 36 on the other end 37 of the spring-loaded retention core 35. Each tab 31 on one of the belts 27 should have an equivalent counterpart tab on the other belt 27.

The retention core 35 is a conventional cylindrical unit which is commonly employed to retain tissue rolls B. In the preferred embodiment of the invention, the retention core 35 is of the spring-loaded variety. The spring-loaded retention core 35 comprises a first hollow cylindrical element 35*a*, a second hollow cylindrical element 35*b* having a diameter only slightly smaller than the diameter of the first element, and a coiled spring 35*c* (see FIGS. 2, 5). The second cylindrical element 35*b* is capable of fitting into the first cylindrical element 35*a*. The coiled spring 35*c* is located in the hollow area formed by the cylindrical elements 35*a*, 35*b* when the second cylindrical element 35*b* is fitted into the first cylindrical element 35*a*. The diameter of the coiled spring 35*c* is slightly smaller than the diameter of the second cylindrical element 35*b*.

Attached to each end 34, 37 of the retention core 35 is a spindle 33, 36. The spindles are inserted into the holes 32 in the tabs 31 of the core holders 30 in order to attach the retention core 35 to the movable belts 27.

In order to remove the retention core 35 from the core holders 30 for the purpose of putting a roll of tissues on the core, one pushes the second cylindrical element 35*b* into the hollow portion of the first cylindrical element 35*a*. This action compresses the spring 35*c* and allows the length of the core 35 to decrease sufficiently to allow it to be removed from the holes 32 in the tabs 31 of the core holders 30.

After the roll of tissues is placed on the retention core 35, the spindles 33, 36 on the cylindrical elements 35*a*, 35*b* are aligned with the holes 32 in the tabs 31 of the core holders 30, and the cylindrical elements are released. The spring 35*c* expands and forces the cylindrical elements to move in opposite directions, thus causing the spindles 33, 36 to enter the holes 32, thereby allowing the core holders 30 to retain the retention core 35.

It should be noted that the core holders 30 and the retention core 35 need not be limited to the embodiment shown.

The foregoing assembly has a cover 38 to render the dispenser aesthetically pleasing to the user. The inside surface of the cover 38 faces the back plate 10. The cover 38 is pivotally attached by hinge pins 39 to the side plates 11, 12 as shown in FIG. 3. To open the cover 38 to replace the paper rolls, one merely releases latch 40 and allows the cover 38 to pivot about the pins 39. The cover 38 has an opening in its bottom portion so that the user has access to the paper rolls when the cover 38 is closed.

OPERATION

To load the dispenser, the cover 38 of the dispenser is unlatched and dropped to its open position (see FIG. 3). A spring-loaded core 35 is inserted through each paper roll. The spindles 33, 36 of the spring-loaded core 35 are inserted into the holes 32 of the tabs 31 of the core holders 30, and the action of the spring 35*c* serves to keep the core 35 in proper positio The cover 38 of the dispenser is then pivoted to the closed position, and the latch 40 operates to retain the cover 38 in this position.

To place a paper roll in such a position so that a user has access to it, one turns the hand wheel 15 in such a way that the rod 14 is caused to rotate. The rotation of the rod 14 brings about rotation of the drive wheels 17. The teeth 29 on the drive wheels 17 engage the holes 28 of the belts 27, thus causing the belts 27 to move over the paths defined by the rollers 19*a*, 19*b*, 20*a*, 20*b*, 21*a*, 21*b*, 22*a*, 22*b*. The user has access to a paper roll when the roll is adjacent to the opening in the cover 38. After a roll is consumed, the user merely repeats the foregoing operation to obtain access to a fresh roll of paper.

The clearance between the belts 27 and the back plate 10 should be of sufficient magnitude that the device can be operated without fear of the tissue rolls B contacting the back plate 10.

This invention is intended to cover all changes and modifications of the example of the invention herein chosen for purposes of the disclosure which do not constitute departures from the spirit and scope of the invention.

What is claimed:

1. A device for storing and dispensing goods which are wound on rolls comprising:

(a) a frame;
(b) a rod supported on the frame, said rod being capable of revolving;
(c) a first drive wheel mounted on said rod;
(d) a second drive wheel mounted on said rod;
(e) a first set of rollers lying in the same plane as the first drive wheel;
(f) means for mounting said first set of rollers in the frame;
(g) a second set of rollers lying in the same plane as the second drive wheel;
(h) means for mounting said second set of rollers in the frame;
(i) a first belt which loops around the first drive wheel and first set of rollers;
(j) a second belt which loops around the second drive wheel and second set of rollers;
(k) a plurality of core holders mounted on said belt to hold the rolls to be stored.

2. The device of claim 1 wherein, the frame has one or more apertures to permit said device to be suspended from a planar surface.

3. The device of claim 1 wherein the frame is formed from a back plate, a right side plate, and a left side plate, said back plate being of rectangular shape, having a top, a bottom, a left side, and a right side, said right side plate projecting at a 90° angle from the right side of the back plate and said left side plate projecting at a 90° angle from the left side of the back plate.

4. The device of claim 3 wherein the right side plate and the left side plate have cross-sections in the shape of a trapezoid.

5. The device of claim 3 wherein the right side plate has an aperture formed therein, and the left side plate has an aperture formed therein, the apertures of the right and left side plates being in axial alignment.

6. The device of claim 5 wherein the rod is secured in hubs which are retained in the apertures of the left side plate and the right side plate.

7. The device of claim 1 wherein the drive wheels are sprocket wheels having teeth formed thereon.

8. The device of claim 7 wherein the belt comprises two plies, an inner ply and an outer ply, said inner ply having holes which engage the teeth of the drive wheel as it is revolving, said outer ply forming the base for said core holders.

* * * * *